US006957516B2

(12) United States Patent
Allaei

(10) Patent No.: US 6,957,516 B2
(45) Date of Patent: Oct. 25, 2005

(54) ACOUSTICALLY INTELLIGENT WINDOWS

(75) Inventor: Daryoush Allaei, Minnetonka, MN (US)

(73) Assignee: Smart Skin, Inc., Chaska, MN (US)

( * ) Notice: Subject to any disclaimer, the term of this patent is extended or adjusted under 35 U.S.C. 154(b) by 0 days.

(21) Appl. No.: 10/308,489

(22) Filed: Dec. 3, 2002

(65) Prior Publication Data

US 2004/0103588 A1 Jun. 3, 2004

(51) Int. Cl.[7] ..... E06B 7/00; E04B 1/82

(52) U.S. Cl. ..... 52/204.591; 52/1; 52/144; 52/787.11; 181/290; 381/71.1

(58) Field of Search ..... 52/204.591, 204.597, 52/171.3, 1, 204.5, 167.1, 786.1, 144, 787.11; 181/290, 175; 381/71.1

(56) References Cited

U.S. PATENT DOCUMENTS

| | | | | |
|---|---|---|---|---|
| 4,352,039 A | | 9/1982 | Hagood | |
| 4,542,611 A | * | 9/1985 | Day | 52/172 |
| 4,829,729 A | | 5/1989 | Derner et al. | |
| 4,877,658 A | | 10/1989 | Calhoon | |
| 4,969,293 A | * | 11/1990 | Guillon | 49/441 |
| 5,131,194 A | | 7/1992 | Anderson | |
| 5,255,764 A | * | 10/1993 | Kurabayashi et al. | 188/380 |
| 5,410,605 A | * | 4/1995 | Sawada et al. | 381/71.14 |
| 5,592,791 A | * | 1/1997 | D'Annunzio et al. | 52/167.2 |
| 5,754,662 A | * | 5/1998 | Jolly et al. | 381/71.4 |
| 5,812,684 A | * | 9/1998 | Mark | 381/86 |
| 5,983,593 A | * | 11/1999 | Carbary et al. | 52/786.11 |
| 6,290,037 B1 | * | 9/2001 | Williams et al. | 188/379 |
| 6,295,788 B2 | * | 10/2001 | Reichert | 52/786.13 |
| 6,360,499 B1 | * | 3/2002 | Sugiura | 52/204.597 |

FOREIGN PATENT DOCUMENTS

| | | | | |
|---|---|---|---|---|
| DE | 198 26 171 C 1 | | 10/1999 | |
| DE | 199 43 084 A 1 | | 4/2001 | |
| JP | 04038390 A | * | 2/1992 | E06B 5/20 |
| JP | 06149267 A | * | 5/1994 | G10K 11/16 |
| WO | WO 97/16817 | | 5/1997 | |
| WO | WO 00/35242 | | 6/2000 | |

* cited by examiner

*Primary Examiner*—Jonathon Szumny
(74) *Attorney, Agent, or Firm*—Leffert Jay & Polglaze, P.A.

(57) ABSTRACT

A window having a frame with a windowpane disposed therein is provided. A first impedance discontinuity element is disposed between the windowpane and the frame adjacent a portion of a periphery of the windowpane. A second impedance discontinuity element is disposed adjacent another portion of the periphery of the windowpane. The first and second impedance discontinuity elements have different impedances.

20 Claims, 9 Drawing Sheets

Fig. 7A
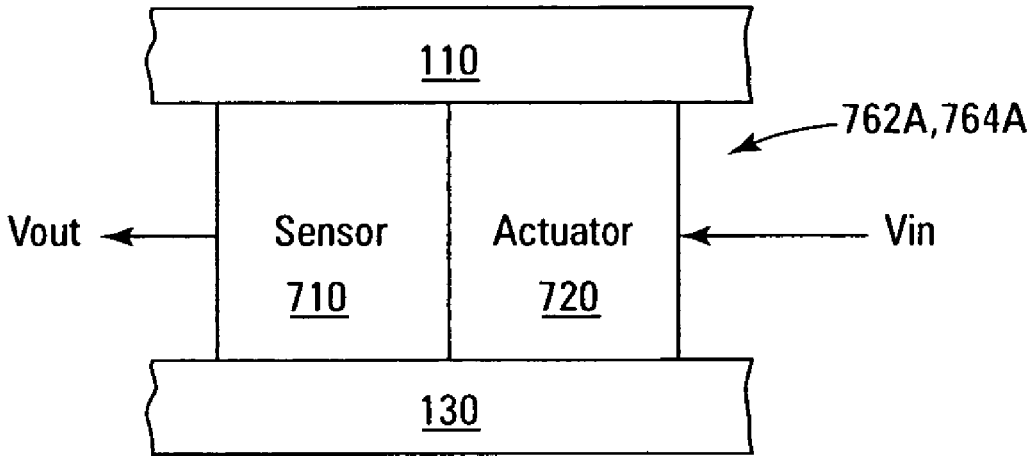
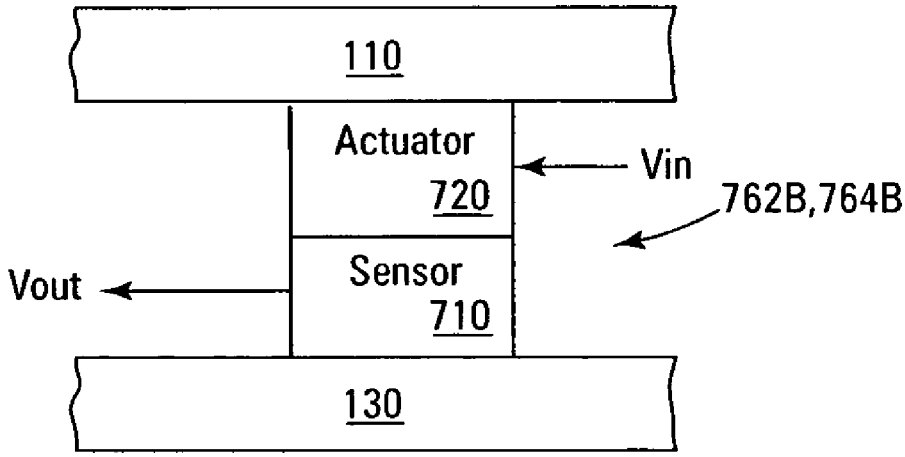
Fig. 7B

*Fig. 8*
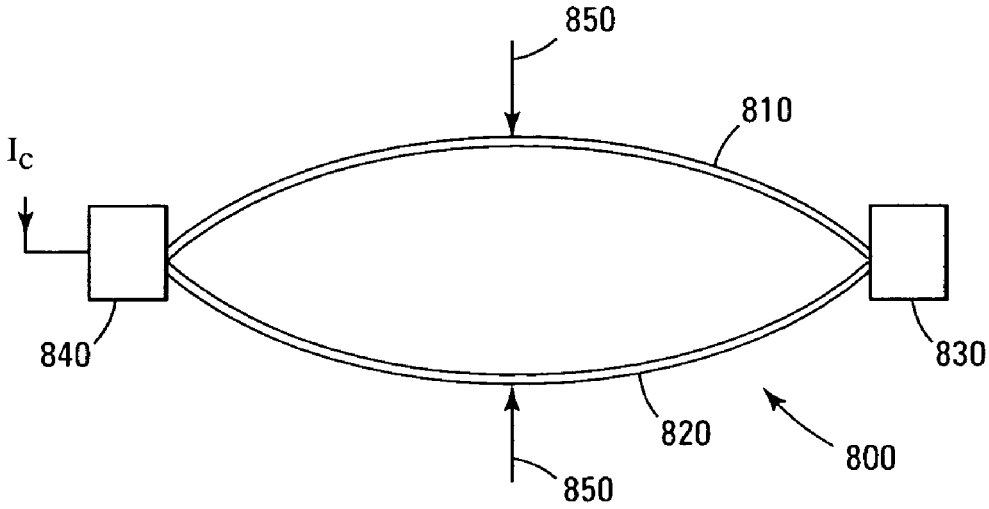
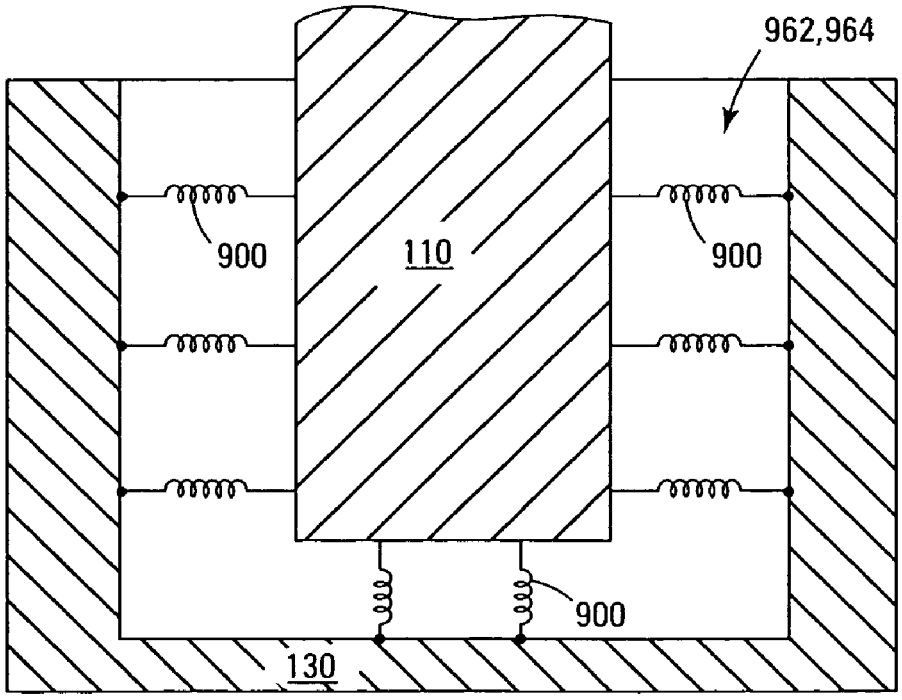
*Fig. 9*

*Fig. 10*
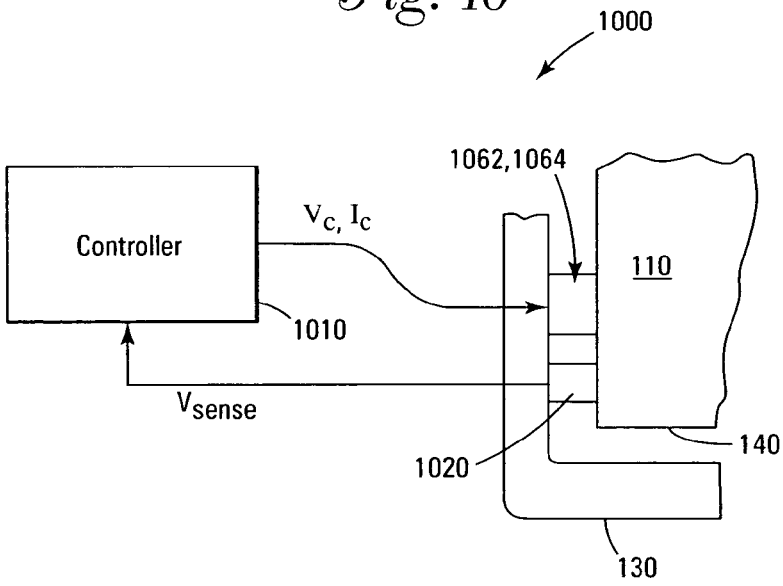
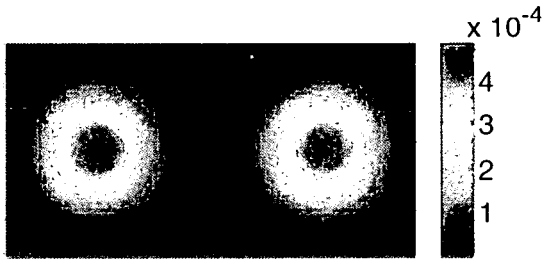
*Fig. 11A*
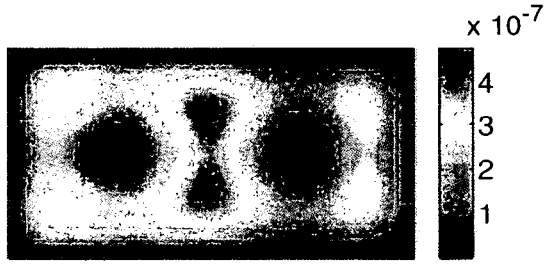
*Fig. 11B*

ACOUSTICALLY INTELLIGENT WINDOWS

TECHNICAL FIELD

The present invention relates generally to the field of windows and, in particular, to noise transmission, noise reduction, and acoustic control in windows.

BACKGROUND

Windows normally include one or more transparent panels (or panes), e.g., of glass, plastic, or the like. Windows are used in buildings, automobiles, airplanes, etc. for admitting light while protecting against heat loss or gain, moisture loss or gain, noise, or the like. One problem with many windows is that they do not always provide adequate protection against noise. To this end, techniques have been developed for reducing sound transmission through windows.

One technique for reducing sound transmission through a window involves a double-paned window with each of the panes having a different thickness for blocking out noise over a broader range of frequencies than two-paned windows with panes having the same thickness. Another technique involves a two-paned window with each of the panes having a different density for blocking out noise over a broader range of frequencies than two-paned windows with panes having the same density. For some techniques, a vibration dampening material is disposed between two windowpanes of different thickness and/or density for dampening vibrations of either windowpane. One problem with these techniques for reducing sound transmission through windows is that they usually require increased frame sizes and more glass compared to conventional two-paned windows, which results in increased costs. Also, these techniques may result in relatively heavier windows and thus may be more difficult to install than conventional windows. Moreover, these techniques are limited to two-paned windows.

Another technique for reducing sound transmission through a window involves laminated windowpanes for reducing sound transmission. However, laminated windowpanes are more expensive than non-laminated windows, e.g., usually about 30 to 60 percent more expensive. Moreover, laminated windows and two-paned windows having panes of different density may alter optical properties of the window.

For the reasons stated above, and for other reasons stated below that will become apparent to those skilled in the art upon reading and understanding the present specification, there is a need in the art for alternative noise suppressing windows.

SUMMARY

One embodiment of the present invention provides a window having a frame with a windowpane disposed therein. A first impedance discontinuity element is disposed between the windowpane and the frame adjacent a portion of a periphery of the windowpane. A second impedance discontinuity element is disposed adjacent another portion of the periphery of the windowpane. The first and second impedance discontinuity elements have different impedances.

Another embodiment of the present invention provides a window having a frame. A plurality of windowpanes is disposed within the frame. Each of the plurality of windowpanes is substantially parallel to another of the plurality of windowpanes, and each of the plurality of windowpanes is separated from another of the plurality of windowpanes by a gap. First and second impedance discontinuity elements are disposed adjacent a periphery of each of the plurality of windowpanes. The first and second impedance discontinuity elements have different impedances. The first and second impedance discontinuity elements of adjacent windowpanes of the plurality of windowpanes are staggered relative to one another.

Another embodiment of the present invention provides a window having a frame with a windowpane disposed therein. A passive impedance discontinuity element is disposed adjacent a portion of a periphery of the windowpane. An active impedance discontinuity element is disposed between the windowpane and the frame adjacent another portion of the periphery of the windowpane. The active impedance discontinuity element is activated so that the active and passive impedance discontinuity elements have different impedances.

Another embodiment of the present invention provides a window having a frame with a windowpane disposed therein. An actuator is disposed between the windowpane and the frame adjacent a periphery of the windowpane. A sensor is disposed between the windowpane and the frame adjacent the periphery of the windowpane. The window also includes a controller having an input electrically coupled to the sensor and an output electrically coupled to the actuator.

BRIEF DESCRIPTION OF THE DRAWINGS

FIGS. 7A, 7B, and 8 illustrate other embodiments of impedance discontinuity elements of the present invention.

FIG. 9 is a cross-sectional view illustrating another embodiment of a impedance discontinuity element of the present invention.

FIG. 10 illustrates a control apparatus according to another embodiment of the present invention.

FIGS. 11A and 11B respectively illustrate vibration energy distributions within a conventional windowpane and a windowpane having impedance discontinuities according to an embodiment of the present invention.

DETAILED DESCRIPTION

In the following detailed description, reference is made to the accompanying drawings that form a part hereof, and in which is shown by way of illustration specific illustrative embodiments in which the invention may be practiced. These embodiments are described in sufficient detail to enable those skilled in the art to practice the invention, and it is to be understood that other embodiments may be utilized and that logical, mechanical and electrical changes may be made without departing from the spirit and scope of the present invention. The following detailed description is, therefore, not to be taken in a limiting sense.

Sound waves impinging on a windowpane cause the windowpane to vibrate. The vibrating windowpane radiates sound at a sound pressure level (SPL) that increases with increasing vibration energy of the windowpane. In addition, radiated sound from a windowpane depends on the distribution of vibration energy within the windowpane and frame structures. Therefore, decreasing the vibration energy of a vibrating windowpane or modifying the vibration energy distribution can reduce sound radiation from the windowpane. Distribution of vibration energy within a vibrating windowpane depends upon conditions at boundaries (or a periphery) of the windowpane. That is, the vibration energy and its distribution within a vibrating windowpane depend upon the way the windowpane is supported at its periphery.

Embodiments of the present invention provide "acoustically intelligent windows" that have impedance (or stiffness) discontinuities at a periphery of a windowpane that act to modify a vibration energy distribution within the windowpane when the windowpane vibrates due to impinging sound waves. In some embodiments, the impedance discontinuities act to reduce the vibration energy of the windowpane. The impedance discontinuities at the periphery of the windowpane can be produced by passive and/or active impedance discontinuity elements that for one embodiment act to reduce the vibration energy through energy management, e.g., redistributing the vibration energy within the windowpane, and energy dissipation. In various embodiments, an impedance discontinuity element is anything that creates an elasticity change in a material or a structure.

Figure 1:
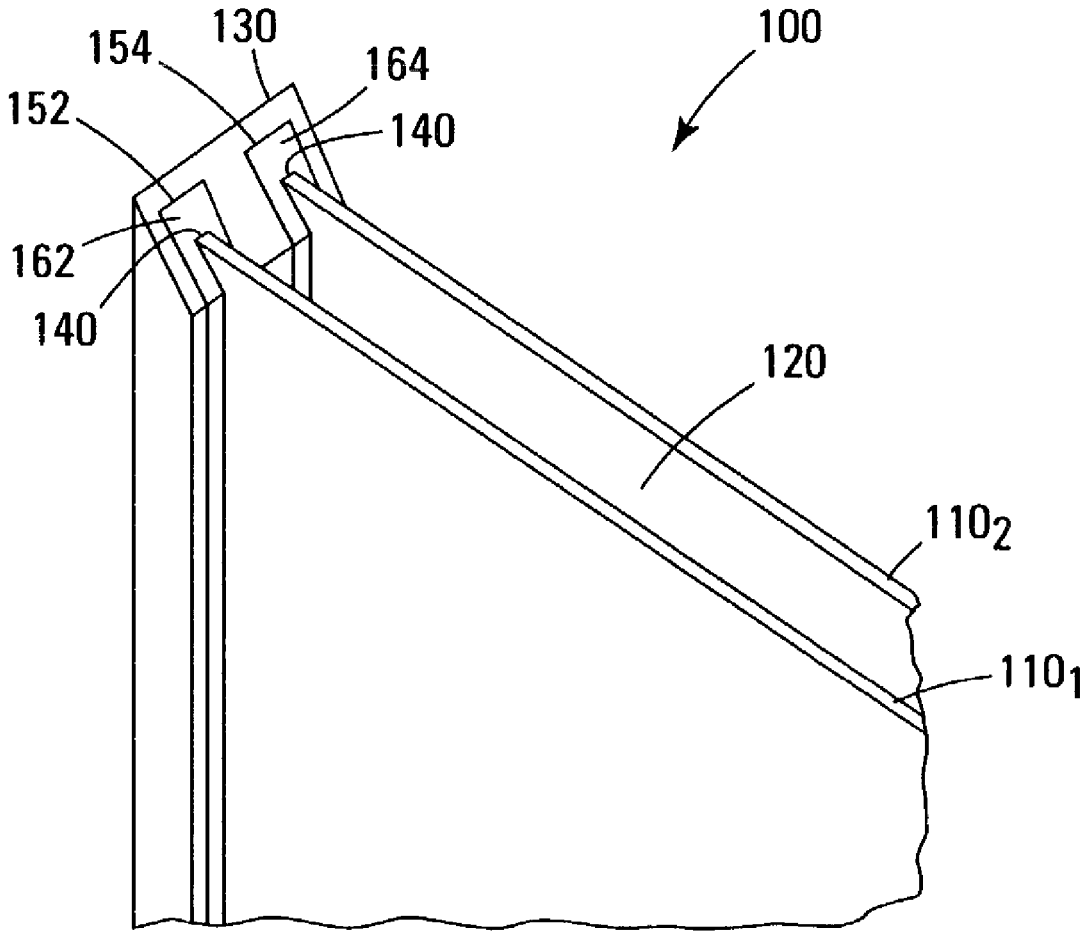
FIG. 1 is a perspective view illustrating a section of a window according to an embodiment of the present invention.

FIG. 1 is a perspective view illustrating a section of a window 100 according to an embodiment of the present invention. Window 100 includes a frame 130. Windowpanes $\mathbf{110}_1$ and $\mathbf{110}_2$ are disposed within frame 130 so that windowpane $\mathbf{110}_1$ is substantially parallel to windowpane $\mathbf{110}_2$. Windowpanes $\mathbf{110}_1$ and $\mathbf{110}_2$ are separated by a gap 120, e.g., filled with a gas, such as air, neon, argon, or the like.

In one embodiment, frame 130 includes slots 152 and 154. First and second impedance discontinuity elements 162 and 164 that have different impedances (or resistances to motion) are respectively disposed within slots 152 and 154 adjacent a periphery 140 of each of windowpanes $\mathbf{110}_1$ and $\mathbf{110}_2$. Impedance discontinuity element 162 forms an interface between windowpane $\mathbf{110}_1$ and frame 130, while impedance discontinuity element 164 forms an interface between windowpane $\mathbf{110}_2$ and frame 130. Impedance discontinuity elements 162 and 164 respectively contact windowpanes $\mathbf{110}_1$ and $\mathbf{110}_2$ adjacent a periphery 140 of each of windowpanes $\mathbf{110}_1$ and $\mathbf{110}_2$ and support windowpanes $\mathbf{110}_1$ and $\mathbf{110}_2$ within frame 130. In one embodiment, either impedance discontinuity element 162 or 164 is frame 130 or is of the same material as frame 130.

Figure 2:
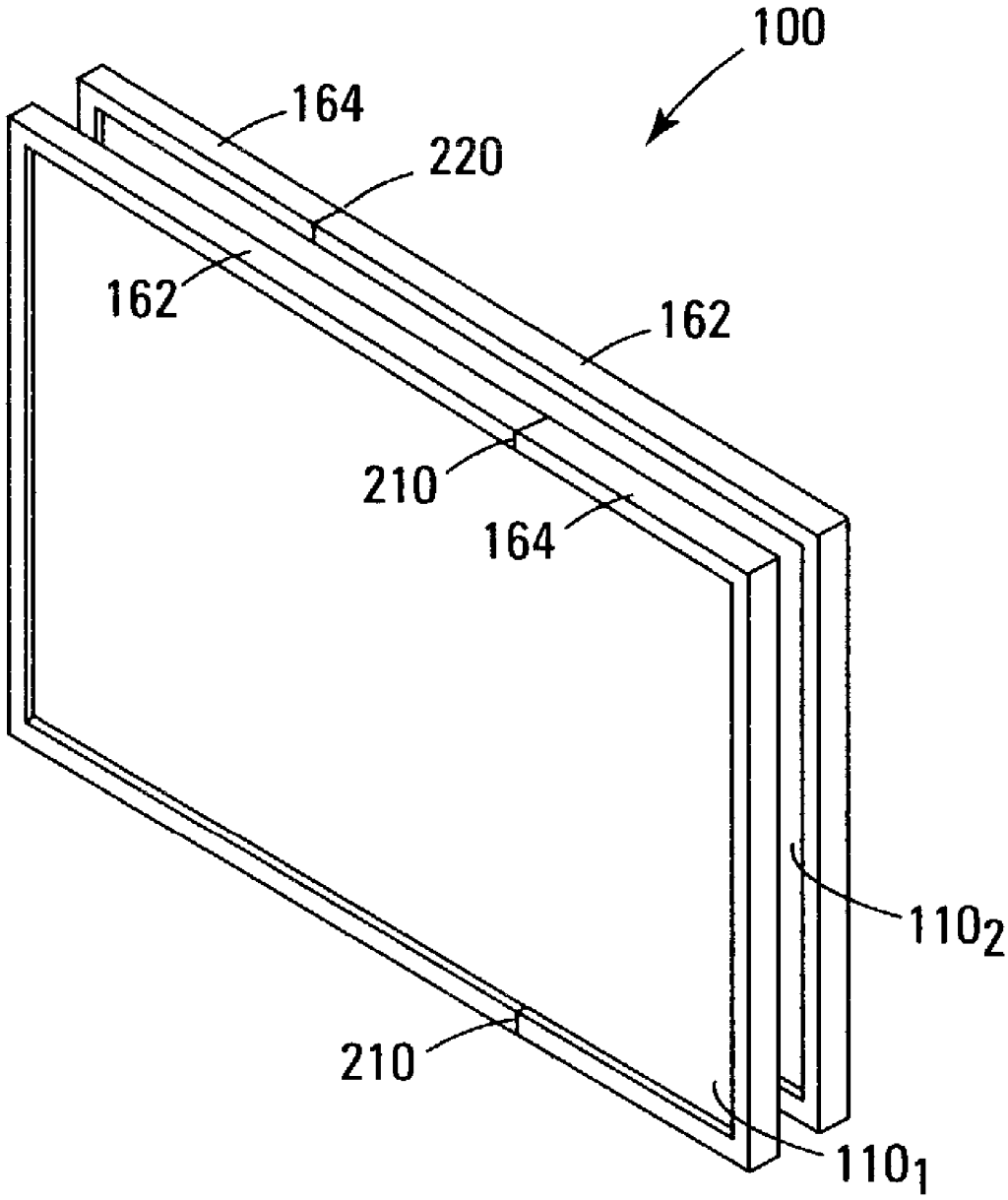
FIG. 2 is a perspective view illustrating a distribution of impedance discontinuity elements around windowpanes of the window of FIG. 1 according to another embodiment of the present invention.

FIG. 2 is a perspective view that illustrates a distribution of impedance discontinuity elements 162 and 164 around periphery 140 of windowpanes $\mathbf{110}_1$ and $\mathbf{110}_2$ according to another embodiment of the present invention. Impedance discontinuity element 162 is disposed around a portion of periphery 140 of windowpane $\mathbf{110}_1$, while impedance discontinuity element 164 is disposed around another portion of periphery 140 of windowpane $\mathbf{110}_1$. This creates impedance discontinuities 210 adjacent periphery 140 of windowpane $\mathbf{110}_1$. Impedance discontinuity element 162 is also disposed around a portion of periphery 140 of windowpane $\mathbf{110}_2$, while impedance discontinuity element 164 is disposed around another portion of periphery 140 of windowpane $\mathbf{110}_2$. This creates stiffness discontinuities 220 at periphery 140 of windowpane $\mathbf{110}_2$. In one embodiment, impedance discontinuity elements 162 and 164 of windowpane $\mathbf{110}_1$ are staggered relative to impedance discontinuity elements 162 and 164 of windowpane $\mathbf{110}_2$, as illustrated in FIGS. 1 and 2, so as to create an impedance discontinuity between windowpanes $\mathbf{110}_1$ and $\mathbf{110}_2$. While FIG. 1 illustrates a window with two windowpanes, the number of windowpanes is not limited to two. Rather, the window can have any number of windowpanes, including a single windowpane.

Figure 3:
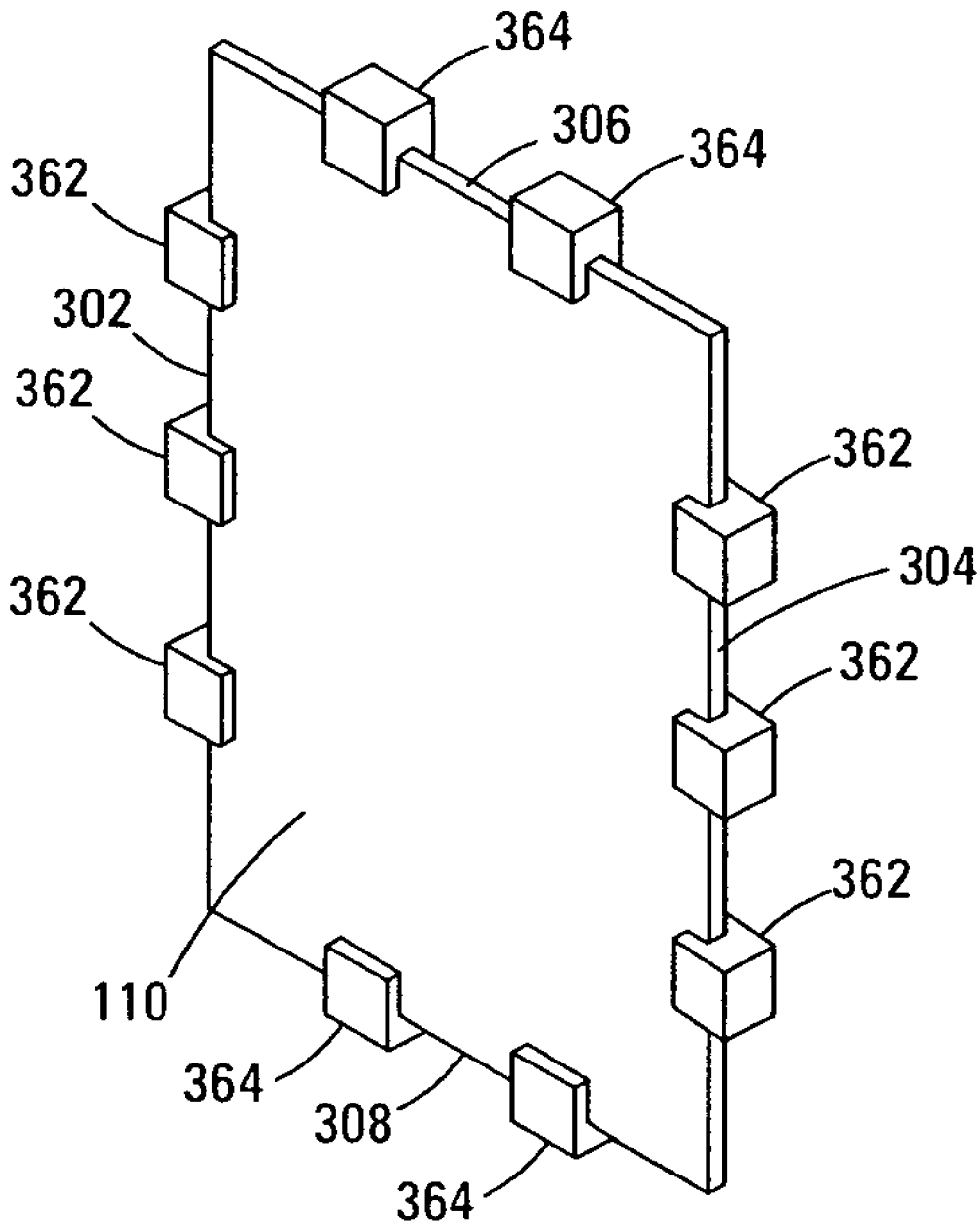
FIG. 3 illustrates discrete impedance discontinuity elements distributed around a windowpane according to another embodiment of the present invention.
Figure 4:
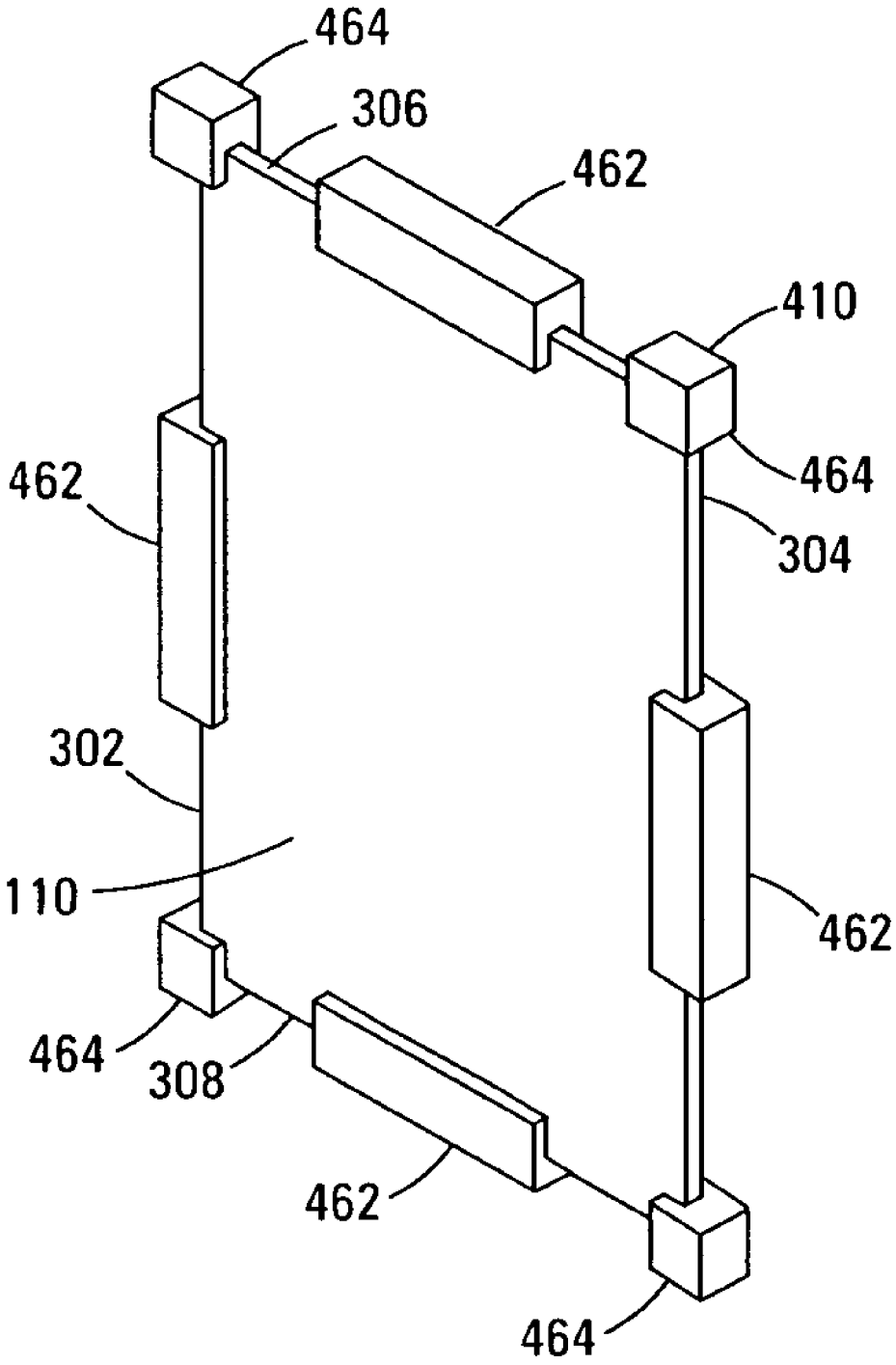
FIG. 4 illustrates discrete impedance discontinuity elements distributed around a windowpane according to yet another embodiment of the present invention.

Impedance discontinuity elements 162 and 164 are not limited to continuous elements, as illustrated in FIGS. 1 and 2. Instead, in another embodiment, impedance discontinuity elements 162 and 164 are discrete elements disposed along one or more portions of periphery 140 of each of windowpanes $\mathbf{110}_1$ and $\mathbf{110}_2$. FIG. 3 shows that for one embodiment, one or more first impedance discontinuity elements 362 are disposed along opposing edges 302 and 304 of a windowpane 110, and one or more second impedance discontinuity elements 364 are disposed along opposing edges 306 and 308 of the window 110 that are located between opposing edges 302 and 304. FIG. 4 shows that for another embodiment, first impedance discontinuity element 462 is disposed along each of boundaries 302, 304, 306, and 308, of a windowpane 110, and a second impedance discontinuity element 464 is disposed at each of corners 410 of the windowpane 110. Placement of the first and second impedance discontinuity elements is not limited to the placements illustrated in FIGS. 2–4. For example, one or more first impedance discontinuity elements and one or more second impedance discontinuity elements can be located opposite each other, e.g., respectively along opposing edges 302 and 304, etc., or in other patterns.

In one embodiment, the first and second impedance discontinuity elements are passive impedance discontinuity elements, e.g., the first and second impedance discontinuity elements can be a solid of steel, an elastomer, wood, etc., a spring, such as coil, leaf, ring, plate, etc., or the like, as long as the first and second impedance discontinuity elements are of different stiffness. For example, in one embodiment, a first impedance discontinuity element is a steel solid, while the second impedance discontinuity element is a wood solid, an elastomeric solid, a spring, or the like. In another embodiment, the first and second impedance discontinuity elements are springs of different stiffness. In some embodiments, the first and second impedance discontinuity elements are holes, slots, notches, or the like in portions of frame 130 for changing the elasticity in the respective portions of the frame. In one embodiment, the first and second discontinuity elements are a damping material, e.g., a viscoelastic material.

In other embodiments, the first and second impedance discontinuity elements are active impedance discontinuity elements (or actuators). In one embodiment, the first and second impedance discontinuity elements are piezoelectric actuators comprising a formulation of lead, magnesium, and niobate (PMN), a formulation of lead, zirconate, and titanate (PZT), or the like. Piezoelectric construction and operation are well known to those in the art. A detailed discussion, therefore, of specific constructions and operation is not provided herein. It will be appreciated that when a voltage is applied to piezoelectric actuators deployed as first and second impedance discontinuity elements, the first and second impedance discontinuity elements impart a force to a windowpane 110 and to a frame 130. In one embodiment, the force produces impedance (or resistance to motion) between a windowpane 110 and frame 130. Applying different voltages to piezoelectric actuators deployed as first and second impedance discontinuity elements causes the first and second impedance discontinuity elements to produce different impedances.

Figure 5:
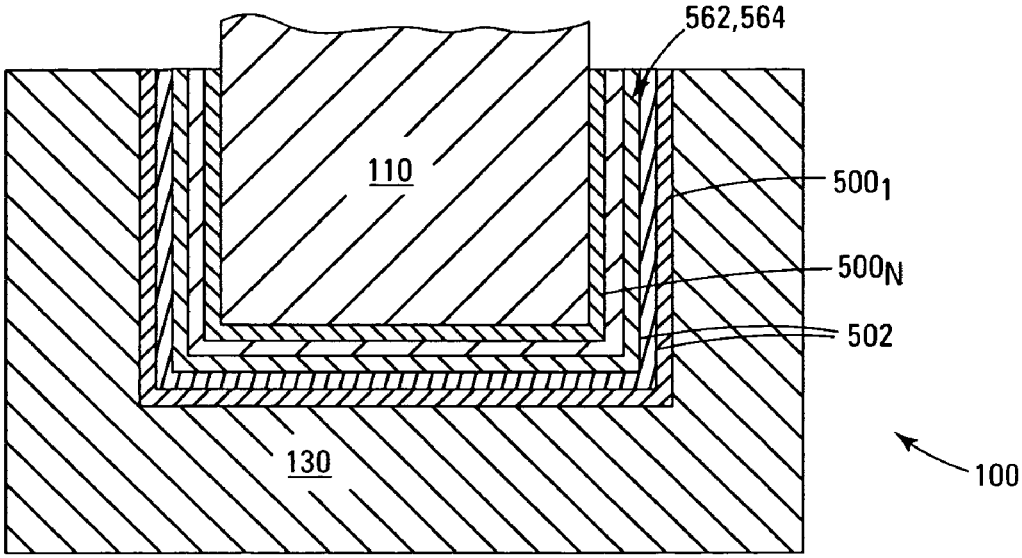
FIG. 5 is a cross-sectional view illustrating an embodiment of an impedance discontinuity element of the present invention.
Figure 6:
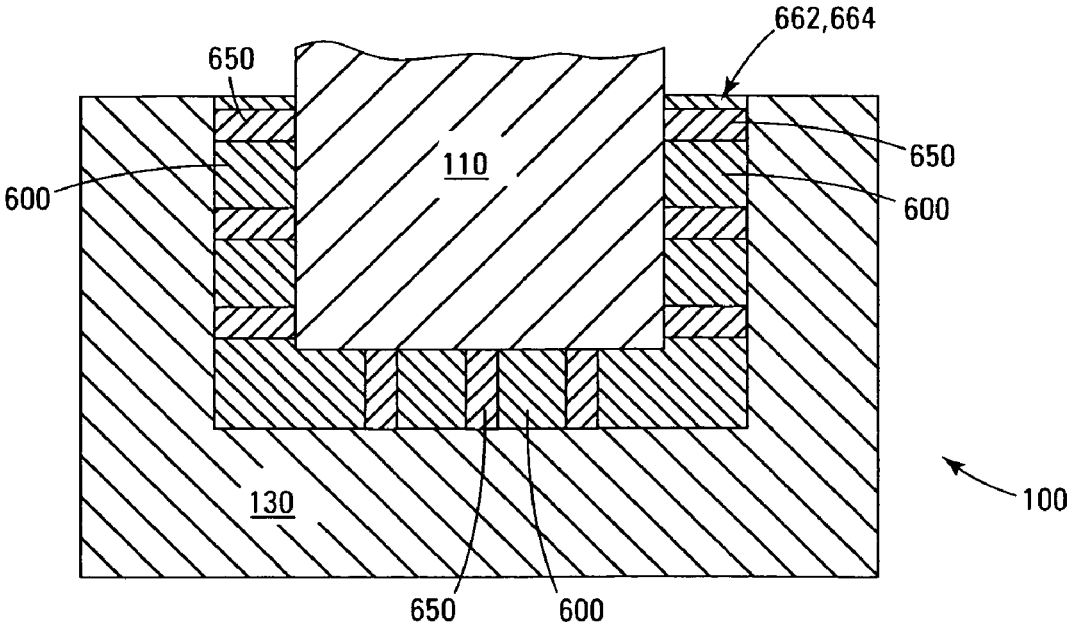
FIG. 6 is a cross-sectional view illustrating another embodiment of an impedance discontinuity element of the present invention.

For one embodiment, first and second impedance discontinuity elements 562 and 564 include piezoelectric layers $\mathbf{500}_1$ to $\mathbf{500}_N$ separated by electrodes 502, e.g., of metal, as illustrated in FIG. 5, a cross-sectional view of a portion of window 100. For another embodiment, first and second impedance discontinuity elements 662 and 664 include a substrate 600 having a number of piezoelectric elements 650 disposed within substrate 600, as illustrated in FIG. 6, a cross-sectional view of a portion of window 100. For some embodiments, piezoelectric elements 650 are piezoelectric rods, piezoelectric tubes, a number of piezoelectric layers, etc.

For other embodiments, the first and second impedance discontinuity elements are piezoelectric benders that operate similarly to a bimetallic strip in a thermostat. For another embodiment, the first and second impedance discontinuity elements are configured as a laminar piezoelectric actuator comprising parallel piezoelectric strips. The displacement of these actuators is perpendicular to the direction of polarization and the electric field. The maximum travel is a function of the length of the strips, and the number of parallel strips determines the stiffness and stability of the element.

In another embodiment, first and second impedance discontinuity elements 762A and 764A (FIG. 7A) and first and second impedance discontinuity elements 762B and 764B (FIG. 7B) include piezoelectric sensor 710 and a piezoelectric actuator 720. In one embodiment, piezoelectric sensor 710 and piezoelectric actuator 720 are integral. In some embodiments, piezoelectric sensor 710 and piezoelectric actuator 720 are stacked substantially parallel to a windowpane 110 and frame 130, as shown in FIG. 7A. That is, piezoelectric sensor 710 and piezoelectric actuator 720 each contact the windowpane 110 and frame 130. In other embodiments, piezoelectric sensor 710 and piezoelectric actuator 720 are collocated (or stacked substantially perpendicular to a windowpane 110 and frame 130, as shown in FIG. 7B). That is, piezoelectric sensor 710 is disposed between piezoelectric actuator 720 and frame 130, while piezoelectric actuator 720 is disposed between piezoelectric sensor 710 and the windowpane 110.

When a voltage Vin is applied to piezoelectric actuator 720, it imparts a force to a windowpane 110 and frame 130 that produces an impedance discontinuity between the windowpane 110 and frame 130. Conversely, when a windowpane 110 imparts a vibratory motion or a force to piezoelectric sensor 710, either directly for the embodiment of FIG. 7A or indirectly via piezoelectric actuator 720 for the embodiment of FIG. 7B, piezoelectric sensor 710 produces voltage Vout that is indicative of the vibratory motion or force.

In another embodiment, the first and second impedance discontinuity elements are actuators formed from shape memory alloys (SMAs). SMAs are materials that have an ability to return to their original shapes through a phase transformation that can take place by inducing heat in the SMA materials. When an SMA is below its transformation temperature, it has very low yield strength and can be easily deformed into a new shape (which it will retain). However, when an SMA is heated above its transformation temperature, it will return to the original shape. If the SMA encounters any resistance during this transformation, it can generate large forces. The most common and useful shape memory materials are Nickel-titanium alloys called Nitinol (Nickel Titanium Naval Ordnance Laboratory).

In one embodiment, the first and second impedance discontinuity elements are leaf springs 800 formed from SMA foils 810 and 820, as shown in FIG. 8, with a relatively large stroke. In one embodiment, clamps 830 and 840 terminate SMA foils 810 and 820, e.g., in a packing density of 40 leaf springs per square inch. When a control current $I_c$ is applied to a leaf spring, the control current produces heat that heats SMA foils 810 and 820, in one embodiment, above their transformation temperature. In one embodiment, this causes foils 810 and 820 to move in a direction indicated by arrows 850 in FIG. 8. In other embodiments, SMA foils 810 and 820 are heated by direct contact conduction, e.g., contacting SMA foils 810 and 820 with a heated material, such as a resistance heated metal or the like. In one embodiment, SMA foils 810 and 820 are heated by convection, e.g., exposing SMA foils 810 and 820 to a heated airflow or the like.

In another embodiment, first and second impedance discontinuity elements 962 and 964 are SMA coil springs 900 disposed between a window 110 and frame 130, as shown in FIG. 9. Applying a control current, in one embodiment, to SMA coil springs 900, e.g., for heating SMA coil springs 900, increases the spring constant by about a factor of ten. In other embodiments, SMA coil springs 900 are heated by direct contact conduction, e.g., contacting SMA coil springs 900 with a heated material, such as a resistance heated metal or the like. In one embodiment, SMA coil springs 900 are heated by convection, e.g., exposing SMA coil springs 900 to a heated airflow or the like.

In various embodiments, the first impedance discontinuity elements can include piezoelectric actuators, and the second impedance discontinuity elements can include SMA actuators and vice versa. In some embodiments, the first impedance discontinuity elements can include passive impedance discontinuity elements, and the second impedance discontinuity elements can include active impedance discontinuity elements, such as piezoelectric and/or SMA actuators, and vice versa. For example, in one embodiment, the first impedance discontinuity elements are SMA coil springs and the second impedance discontinuity elements are passive coil springs. When no current is supplied to the SMA coil springs, the passive and SMA coil springs have the same stiffness. On the other hand, when current is supplied to the SMA coil springs, the stiffness of the SMA springs is increased, e.g., by up to a factor of ten, and the passive and SMA coil springs have a different stiffness.

FIG. 10 illustrates a control apparatus 1000 for controlling sound radiation from a window according to another embodiment of the present invention. In this embodiment, first impedance discontinuity elements 1062 and/or second impedance discontinuity elements 1064 are actuators, e.g., piezoelectric and/or SMA actuators. An output of controller 1010 is coupled to each of impedance discontinuity elements 1062 and/or 1064. An input of controller 1010 is coupled to a vibration sensor 1020, e.g., a piezoelectric sensor, such as piezoelectric sensor 710 of FIGS. 7A and 7B, etc. In one embodiment, vibration sensor 1020 is attached to a windowpane 110 adjacent periphery 140, as shown in FIG. 10. In another embodiment, vibration sensor 1020 is disposed between a windowpane 110 and frame 130, as further shown in FIG. 10. For some embodiments, impedance discontinuity elements 1062 and/or 1064 are as described for FIGS. 7A or 7B and include a sensor and an actuator.

Controller 1010 receives signals (for example sensed voltage $V_{sense}$) from vibration sensor 1020 indicative of vibrations adjacent periphery 140 of the windowpane 110 transmitted to vibration sensor 1020. Controller 1010 generates and transmits signals to impedance discontinuity elements 1062 and/or 1064, e.g., a control voltage $V_c$ for a piezoelectric actuator or a control current $I_c$ for a SMA actuator, to adjust the impedance between the windowpane 110 and frame 130.

In various embodiments, the impedance is adjusted to create an impedance discontinuity adjacent periphery 140 of a single windowpane 110 that is vibrating due to sound waves impinging thereon. The stiffness discontinuity acts to modify the vibration energy distribution within the windowpane 110. For various embodiments, the stiffness discontinuity acts to reduce the vibration energy of the windowpane 110 and thus the sound radiation therefrom. In another embodiment, impedance discontinuities adjacent periphery 140 of the windowpane 110 redirect or confine vibration energy to a predetermined part of the windowpane 110 or frame 130. In some embodiments, a passive impedance discontinuity element is used to dissipate the redirected or confined vibration energy.

FIGS. 11A and 11B respectively illustrate vibration energy distributions within a conventional windowpane and a windowpane having impedance discontinuities adjacent a periphery of the windowpane according to an embodiment of the present invention, as obtained from a finite-element computer simulation. It is seen that the impedance discontinuities act to modify the vibration energy distribution within the windowpane. Moreover, for this embodiment, it is seen that modifying the vibration energy distribution acts to reduce the vibration energy, e.g., by about three orders of magnitude.

In other embodiments, adjusting the impedance creates an impedance discontinuity between the peripheries of successive windowpanes, such as between windowpanes $\mathbf{110}_1$ and $\mathbf{110}_2$, as well as impedance discontinuities adjacent the periphery of each of the windowpanes. For example, for windowpanes $\mathbf{110}_1$ and $\mathbf{110}_2$, when sound waves impinge upon windowpane $\mathbf{110}_1$, an impedance discontinuity adjacent periphery 140 of windowpane $\mathbf{110}_1$ acts to modify the vibration energy distribution within windowpane $\mathbf{110}_1$. For various embodiments, the impedance discontinuity adjacent periphery 140 of windowpane $\mathbf{110}_1$ acts to reduce the vibration energy of windowpane $\mathbf{110}_1$. Moreover, an impedance discontinuity between the windowpanes $\mathbf{110}_1$ and $\mathbf{110}_2$ acts to reduce the transfer of vibration energy from windowpane $\mathbf{110}_1$ to windowpane $\mathbf{110}_2$. An impedance discontinuity adjacent periphery 140 of windowpane $\mathbf{110}_2$ acts to modify the vibration energy distribution within windowpane $\mathbf{110}_2$. For various embodiments, the impedance discontinuity adjacent periphery 140 of windowpane $\mathbf{110}_2$ acts to reduce the vibration energy of windowpane $\mathbf{110}_2$ and thus the sound radiation therefrom.

In another embodiment, impedance discontinuities adjacent periphery 140 of each of windowpanes $\mathbf{110}_1$ and $\mathbf{110}_2$ redirect or confine vibration energy to a predetermined part of each the windowpanes $\mathbf{110}_1$ and $\mathbf{110}_2$ or frame 130. In some embodiments, passive impedance discontinuity elements are used to dissipate the confined or redirected vibration energies.

Figure 12:
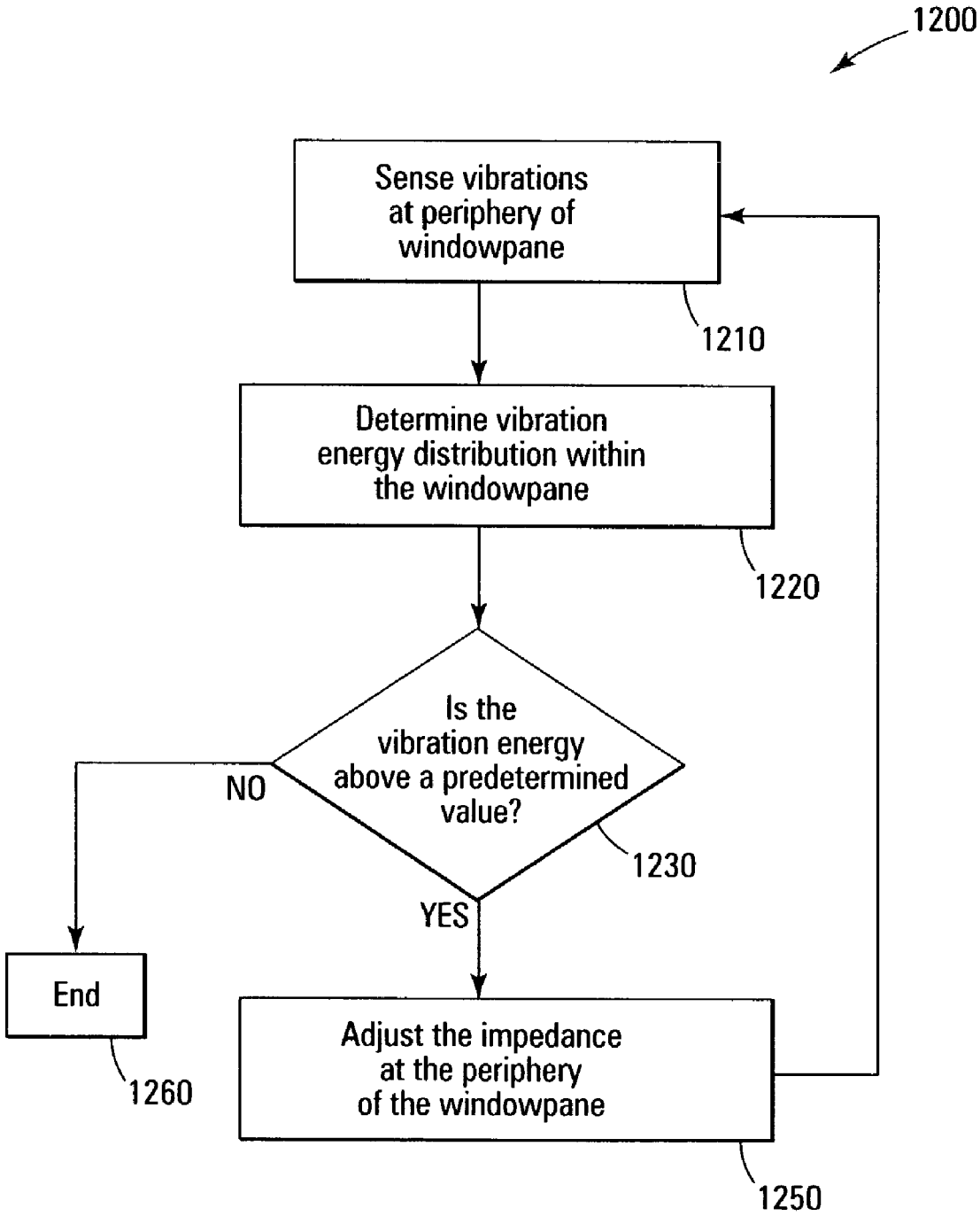
FIG. 12 is a flowchart of a method for controlling sound radiation from a window according to another embodiment of the present invention.

FIG. 12 is a flowchart of a method 1200 for controlling sound radiation from a window according to another embodiment of the present invention. At block 1210, vibration sensor 1020 senses vibrations adjacent periphery 140 of a windowpane 110 of window 100 that is vibrating due to sound waves impinging thereon. A signal indicative of the vibration is transmitted from vibration sensor 1020 to controller 1010. Controller 1010 determines a vibration energy distribution within the windowpane 110 and thus the sound radiation from window 100 at block 1220. In one embodiment, controller 1010 calculates the vibration energy distribution in the windowpane 110 and thus the sound radiation from window 100 from the vibrations at periphery 140 as indicated by signals from vibration sensor 1020. In another embodiment, controller 1010 compares signals from vibration sensor 1020 to historical vibration data (usually called "baseline data" by those skilled in the art) to determine the vibration energy distributions in the windowpane 110 and thus the sound radiation from window 100.

When the vibration energy is above a predetermined level at decision block 1230, controller 1010 determines, e.g., from calculations or comparisons to baseline data, the stiffness distribution at periphery 140 for reducing vibration energy below the predetermined level, for modifying the vibration energy distribution within the windowpane 110, or for redirecting or confining the vibration energy to a predetermined part of the windowpane 110. Subsequently, at block 1250, controller 1010 transmits signals to impedance discontinuity elements 1062 and/or 1064 to adjust the impedance between the windowpane 110 and frame 130 for obtaining the above-determined stiffness distribution adjacent periphery 140. Method 1200 then returns to block 1210. When the vibration energy is less than or equal to a predetermined value at decision block 1230, method 1200 ends at block 1260.

In one embodiment, impedance discontinuity elements 1062 and/or 1064 induce a set of forces proportional to the spatial derivative (i.e., strain, shear force) of the structure at the point of application. In another embodiment, impedance discontinuity elements 1062 and/or 1064 induce a set of forces defined by a vortex power flow (VPF), e.g., as described in U.S. patent application Ser. No. 09/724,369, entitled SMART SKIN STRUCTURES, filed Nov. 28, 2000 (pending), which application is incorporated herein by reference.

CONCLUSION

Although specific embodiments have been illustrated and described herein, it will be appreciated by those of ordinary skill in the art that any arrangement that is calculated to achieve the same purpose may be substituted for the specific embodiments shown. Many adaptations of the invention will be apparent to those of ordinary skill in the art. Accordingly, this application is intended to cover any adaptations or variations of the invention. It is manifestly intended that this invention be limited only by the following claims and equivalents thereof.

What is claimed is:

1. A method for controlling vibration in a window, the method comprising:

disposing a windowpane within a frame disposing a first impedance discontinuity element between the windowpane and the frame adjacent a portion of a periphery of the windowpane; and disposing a second impedance discontinuity element adjacent another portion of the periphery of the windowpane, the first and second impedance discontinuity elements having different impedances;

wherein disposing the first impedance discontinuity element between the frame and the windowpane comprises disposing a shape memory alloy actuator between the frame and the windowpane.

2. The method of claim 1, wherein disposing a second impedance discontinuity element adjacent another portion of the periphery of the windowpane further comprises disposing the second impedance discontinuity element between the windowpane and the frame adjacent the another portion of the periphery of the windowpane.

3. The method of claim 1, wherein the second discontinuity element is passive or active.

4. A method for controlling sound radiation from a window, the method comprising:

sensing vibrations adjacent a periphery of one or more windowpanes of the window;

determining a vibration energy distribution within the windowpane, including central portions of the windowpane away from the frame, from the sensed vibrations; and adjusting an impedance at the periphery of the one or more windowpanes based on the determined vibration energy distribution.

5. A window comprising:

a frame;

a windowpane disposed within the frame;

a first impedance discontinuity element disposed between the windowpane and the frame adjacent a portion of a periphery of the windowpane; and a second impedance discontinuity element adjacent another portion of the periphery of the windowpane, the first and second impedance discontinuity elements having different impedances;

wherein at least one of the first impedance discontinuity element and the second impedance discontinuity element is a shape memory alloy actuator.

6. A window comprising:

a frame;

a windowpane disposed within the frame;

an actuator disposed between the windowpane and the frame adjacent a periphery of the windowpane;

a sensor disposed between the windowpane and the frame adjacent the periphery of the windowpane; and a controller having an input electrically coupled to the sensor and an output electrically coupled to the actuator, wherein the controller determines a stiffness at the periphery of the windowpane according to signals from the sensor.

7. A window comprising:

a frame;

a plurality of windowpanes disposed within the frame, each of the plurality of windowpanes substantially parallel to another of the plurality of windowpanes, each of the plurality of windowpanes separated from another of the plurality of windowpanes by a gap; and first and second impedance discontinuity elements adjacent a periphery of each of the plurality of windowpanes;

wherein at least one of the first impedance discontinuity elements is a shape memory alloy actuator.

8. The window of claim 7, wherein at least one of the second impedance discontinuity elements is passive.

9. The window of claim 7, wherein at least one second impedance discontinuity element is a portion of the frame.

10. The window of claim 7, and further comprising a vibration sensor located between each of the plurality of windowpanes and the frame.

11. The window of claim 10, and further comprising a controller having an input electrically coupled to each vibration sensor and an output electrically coupled to the shape memory alloy actuator corresponding to the at least one of the first impedance discontinuity elements.

12. The window of claim 7, wherein the first and second impedance discontinuity elements are located between each of the plurality of windowpanes and the frame.

13. A method for controlling vibration in a window, the method comprising:

disposing a windowpane within a frame;

creating an impedance discontinuity adjacent the periphery of the windowpane;

wherein creating the impedance discontinuity adjacent the periphery of the windowpane comprises disposing an impedance discontinuity element between the frame and the windowpane adjacent a portion of the periphery of the windowpane; and wherein disposing the impedance discontinuity element between the frame and the windowpane comprises disposing an actuator between the frame and the windowpane;

disposing a vibration sensor between the frame and the windowpane; and connecting the actuator to an output of a controller and connecting the vibration sensor to an input of the controller, wherein the controller determines a stiffness distribution at the periphery of the windowpane for modifying a vibration energy distribution within the windowpane when the vibration energy of the windowpane exceeds a predetermined value.

14. The method of claim 13, wherein disposing the actuator between the frame and the windowpane comprises disposing at least one of a piezoelectric actuator and a shape memory alloy actuator between the frame and the windowpane.

15. A method for controlling sound radiation from a window, the method comprising:

disposing a plurality of windowpanes within a frame so that each of the plurality of windowpanes is substantially parallel to another of the plurality of windowpanes and so that each of the plurality of windowpanes is separated from another of the plurality of windowpanes by a gap;

creating an impedance discontinuity adjacent a periphery of each of the plurality of windowpanes;

wherein creating the impedance discontinuity adjacent the periphery of each of the plurality of windowpanes comprises disposing an impedance discontinuity element between the frame and each of the plurality of windowpanes adjacent a portion of the periphery of each of the plurality of windowpanes; and wherein disposing the impedance discontinuity element between the frame and each of the plurality of windowpanes comprises disposing an actuator between the frame and each of the plurality of windowpanes;

disposing a vibration sensor between the frame and each of the plurality of windowpanes; and connecting the actuator of each of the plurality of windowpanes to an output of a controller and connecting the vibration sensor of each of the plurality of windowpanes to an input of the controller;

wherein the controller calculates a vibration energy distribution in the windowpane according to signals from the sensor; and wherein the controller determines a stiffness distribution at the periphery of the windowpane for modifying the vibration energy distribution when the vibration energy of the windowpane exceeds a predetermined value.

16. The method of claim 15, further comprises creating an impedance discontinuity between adjacent windowpanes of the plurality of windowpanes.

17. The method of claim 16, wherein creating the impedance discontinuity between adjacent windowpanes of the plurality of windowpanes comprises staggering first and second impedance discontinuity elements adjacent the periphery of each of the adjacent windowpanes relative to one another.

18. A method for controlling sound radiation from a window, the method comprising:

sensing vibrations adjacent a periphery of one or more windowpanes of the window;

determining a vibration energy distribution within the windowpane from the sensed vibrations; and adjusting an impedance at the periphery of the one or more windowpanes based on the determined vibration energy distribution;

wherein adjusting the impedance at the periphery of the one or more windowpanes comprises determining a stiffness at the periphery of the one or more windowpanes.

19. A method for controlling vibration in a window, the method comprising:

sensing vibrations adjacent a periphery of a windowpane of the window;

determining a vibration energy distribution within the windowpane from the sensed vibrations;

determining a stiffness distribution at the periphery for modifying a vibration energy distribution within the windowpane when the vibration energy of the windowpane exceeds a predetermined value; and modifying the vibration energy distribution within the windowpane by adjusting an impedance at the periphery of the windowpane when the vibration energy of the windowpane exceeds the predetermined value.

20. The method of claim 19, wherein modifying the vibration energy distribution within the windowpane comprises redirecting or confining the vibration energy to a predetermined part of the windowpane.

* * * * *